US009591940B2

(12) United States Patent
Fenster

(10) Patent No.: US 9,591,940 B2
(45) Date of Patent: Mar. 14, 2017

(54) SOLAR SHADE APPARATUS AND METHOD

(71) Applicant: Loretta Catherine Fenster, San Diego, CA (US)

(72) Inventor: Loretta Catherine Fenster, San Diego, CA (US)

( * ) Notice: Subject to any disclaimer, the term of this patent is extended or adjusted under 35 U.S.C. 154(b) by 0 days.

(21) Appl. No.: 14/809,184

(22) Filed: Jul. 25, 2015

(65) Prior Publication Data

US 2016/0183707 A1 Jun. 30, 2016

Related U.S. Application Data

(60) Provisional application No. 62/030,992, filed on Jul. 30, 2014.

(51) Int. Cl.

| | |
|---|---|
| ***A47H 23/01*** | (2006.01) |
| ***A47H 1/022*** | (2006.01) |
| *A47H 23/02* | (2006.01) |

(52) U.S. Cl.

CPC ..... *A47H 1/022* (2013.01); *A47H 23/01* (2013.01); *A47H 2023/025* (2013.01)

(58) Field of Classification Search

CPC ... A47H 1/022; A47H 23/01; A47H 2023/025
USPC ..... 160/330, 349.1, DIG. 16, 387
See application file for complete search history.

(56) References Cited

U.S. PATENT DOCUMENTS

| | | | | | |
|---|---|---|---|---|---|
| 2,069,600 | A * | 2/1937 | Coleman | A47K 3/38 | 160/330 |
| 2,474,552 | A * | 6/1949 | Steinmeyer | A47H 13/14 | 160/348 |
| 3,116,784 | A * | 1/1964 | Dwyer | A47H 13/16 | 160/349.1 |
| 3,224,495 | A * | 12/1965 | Truesdale | A47H 23/01 | 160/349.1 |
| 3,255,809 | A * | 6/1966 | Kawczynski | A47H 13/16 | 160/349.1 |
| 3,282,328 | A * | 11/1966 | Mushro | A47H 19/00 | 160/349.1 |
| 4,723,326 | A * | 2/1988 | Tarlow | A47K 3/38 | 160/349.1 |
| 4,874,028 | A * | 10/1989 | Lynch | A47H 99/00 | 160/126 |
| 5,495,628 | A * | 3/1996 | Logan | A47K 3/38 | 160/330 |
| 5,953,771 | A * | 9/1999 | VanHuss | A47K 3/38 | 16/320 |
| 6,336,232 | B1 * | 1/2002 | Toder | A47K 3/38 | 4/558 |
| 8,028,381 | B2 * | 10/2011 | Murray | A47H 23/01 | 160/395 |
| 2008/0000056 | A1 * | 1/2008 | Murray | A47H 23/01 | 24/460 |

* cited by examiner

*Primary Examiner* — David Purol
(74) *Attorney, Agent, or Firm* — Erik Vieira

(57) ABSTRACT

An apparatus for shading a window, wherein the window has a right top corner and a top left corner, comprising a rod element, which has a proximate end and a distal end and is disposed along a lateral axis substantially parallel to a lateral window axis. The apparatus further has a spring element, having a first end mechanically coupled to the rod element at the proximate end of the rod element, wherein the spring element is adapted to provide a spring constant force between the rod element and the top left corner of the window.

20 Claims, 5 Drawing Sheets

SOLAR SHADE APPARATUS AND METHOD

This non provisional patent application claims the benefit of priority to U.S. provisional patent application entitled, "INSTA-FIT SOLAR SHADE", filed Jul. 30, 2014, having Ser. No. 62/030,992 and is incorporated by reference in its entirety.

FIELD

The present disclosure relates to apparatuses and methods for providing shade for a window.

BACKGROUND

Lack of adequate shading of windows, both in buildings and motor homes can lead to damage of interior furnishings due to sun exposure and limited personal privacy.

Current state of the art solutions for providing shaded curtains are limited in their applications for a variety of reasons. Most windows shading solutions require installation of hardware into the window framing, which generally requires invasive measures such as drilling holes and/or driving screws into the window frame, thereby causing permanent damage to the surrounding structure. In some situations, such as for example college student dormitories, the walls and windows are often made of cylinder blocks, which are difficult or impossible to drive hardware, such as screws, into. Moreover, curtain rods are generally of a single length, therefore precise measurements must be taken prior to purchasing a specific length of curtain and rod.

The present teachings address these issues and provide a better solution than current, state of the art solutions provide, as will now be disclosed.

SUMMARY

An apparatus for shading a window, wherein the window has a right top corner and a top left corner, comprising a rod element, which has a proximate end and a distal end and is disposed along a lateral axis substantially parallel to a lateral window axis. The apparatus further has a spring element, having a first end mechanically coupled to the rod element at the proximate end of the rod element, wherein the spring element is adapted to provide a spring constant force between the rod element and the top left corner of the window. A solar shade fabric, adapted to filter ultra violet rays is removably affixed to the rod element along a lateral axis of the rod element, wherein the rod element distal end is mechanically coupled to the right top corner of the window and the spring element is further mechanically coupled at the second to the top left corner of the window.

BRIEF DESCRIPTION OF THE DRAWINGS

Embodiments of the present disclosure will be more readily understood by reference to the following figures, in which like reference numbers and designations indicate like elements.

FIG. 2*a* is a cafe rod element of a solar shade curtain, according to one embodiment of the present teachings.

FIG. 2*b* is an exploded view of a cafe rod element of a solar shade curtain, according to one embodiment of the present teachings.

DETAILED DESCRIPTION

Figure 1A:
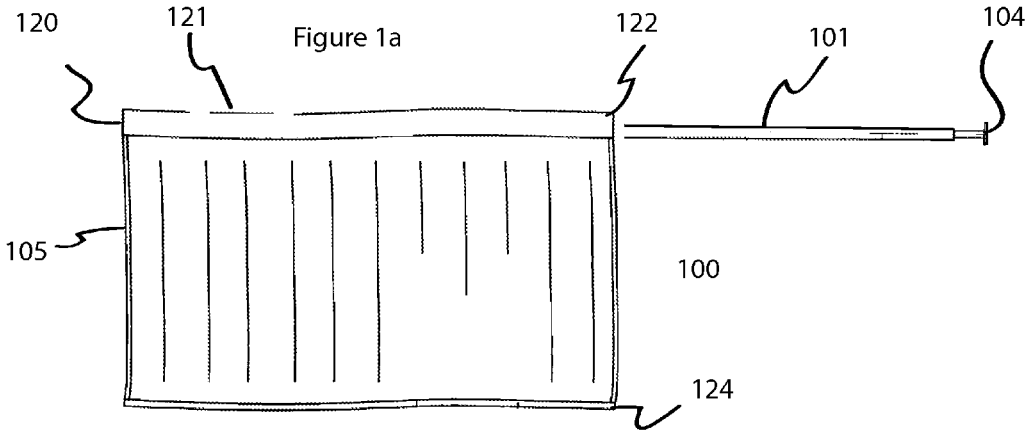
FIG. 1*a* illustrates a front plan view of a solar shade apparatus, according to one embodiment of the present teachings.

Embodiments of the present teachings may be used in conjunction with, inter alia, window blinds, curtains, and shutters to contribute to protecting furniture and carpet from the sun's damaging rays. Variations of the present disclosure may be used to thermally stabilize an interior of a dwelling, building or vehicle by minimizing incident sunlight on a window without needing to create holes in window seals. Reduction in harsh glare of a window's reflection, while simultaneously maintaining a see-through view or to completely block a view for privacy are advantages of the present teachings. Users will find ease of use and installation among the many advantages of the present teachings.

Referring now generally to FIGS. 1*a*, 1*b*, 1*c*, 1*d*, 1*e*, 1*f* a solar shade apparatus 100 is disclosed. The solar shade apparatus 100 generally comprises a rod element 101, a spring element 112, and a solar shade fabric 105. It will be appreciated that the material used to compose the solar shade fabric 105 may be of any material suitable for providing semi-transparent and/or full blocking of light, including but not limited to paper. The rod element 101 comprises a proximate end 102 and a distal end 104. It will be appreciated that both the proximate end 102 and the distal end 104 are adapted to conform to the contours of a window jam (not shown). A window jam, within which the subject of the present teachings may be used comprises a lateral axis and a vertical axis. The rod element 101 is aligned substantially parallel with the lateral axis of the window jam at any vertical level a user desires. In one embodiment, the rod element 101 comprises a spring element 112, disposed on an interior portion of the rod element 101 and functions to provide a restoring force according to Equation 1 below:

$$F_r = -kX \qquad \text{Equation 1:}$$

In Equation 1, "$F_r$" is a restoring force, which operates in a direction opposite to the direction of compression. "X" is substantially parallel to the lateral axis of rod element 101. "k" is a spring constant, which depends upon the spring thickness, length and material. Equation 1 describes a restoring force, equal to a spring constant, multiplied by the lateral displacement of the spring.

Figure 1B:
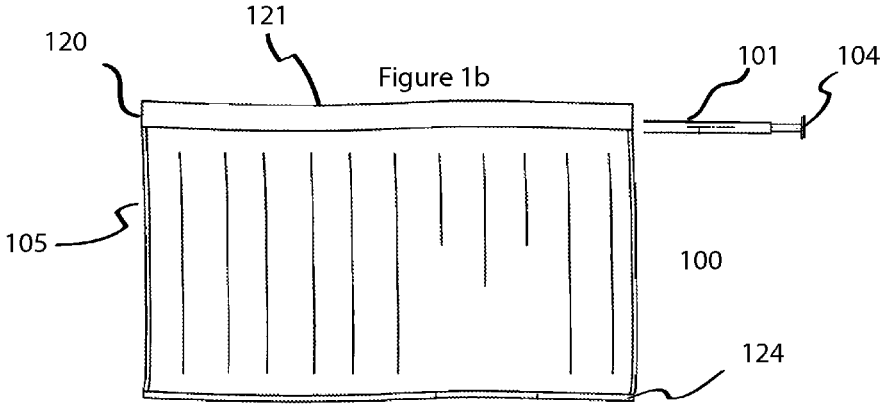
FIG. 1*b* illustrates a front plan view of a solar shade apparatus, according to one embodiment of the present teachings.
Figure 1C:
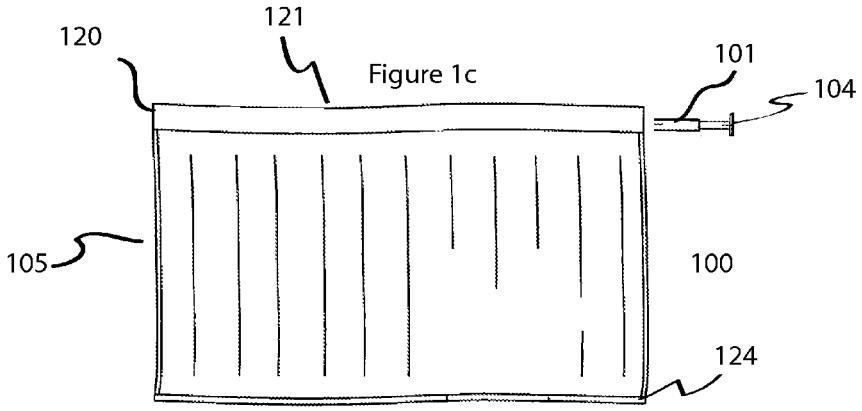
FIG. 1*c* illustrates a front plan view of a solar shade apparatus, according to one embodiment of the present teachings.
Figure 1D:
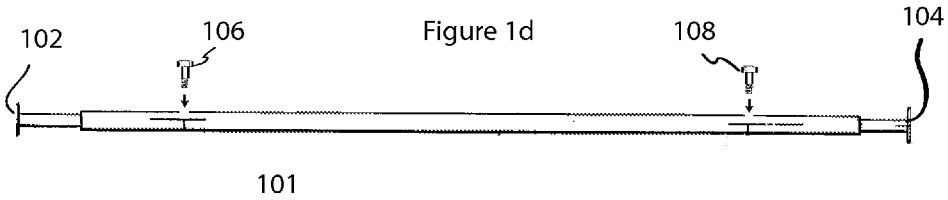
FIG. 1*d* illustrates a side plan view of a curtain rod, according to one embodiment of the present teachings.

A rod pocket 121, having a proximate rod pocket end 122 and a distal rod pocket end 120 is disclosed and adapted to accommodate the rod element 101 therethrough, as illustrated in one embodiment in FIG. 1*a*, FIG. 1*b* and FIG. 1*c*. A rod element 101 comprises a proximate end 102 which is adapted to be inserted into the rod pocket 121 at the proximate rod pocket end 122. The rod element 101 is adapted to fit substantially entirely within the rod pocket 121, such that the rod pocket proximate end 102 is aligned with the distal rod pocket end 120 and the distal end 104 of the rod element 101 aligns with the proximate rod pocket end 122. The rod pocket 121 is disposed at a top portion of the solar shade fabric 105, which is either sewn or fused by heat or glue.

Figure 1E:
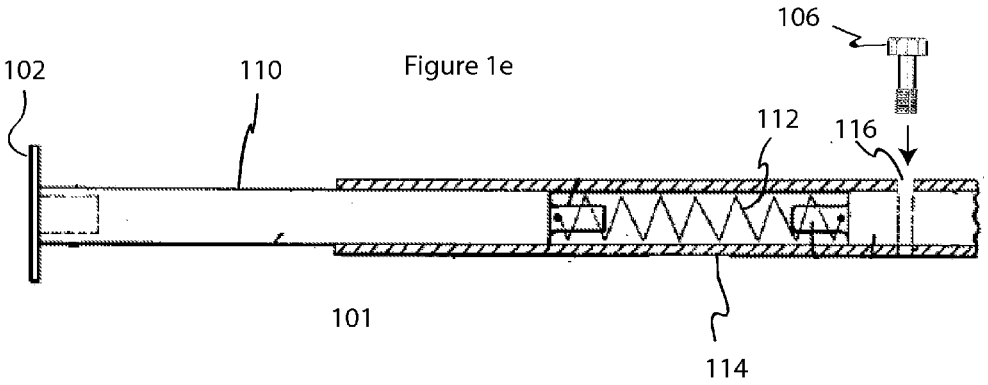
FIG. 1*e* illustrates an exploded view of a curtain rod, according to one embodiment of the present teachings.
Figure 1F:
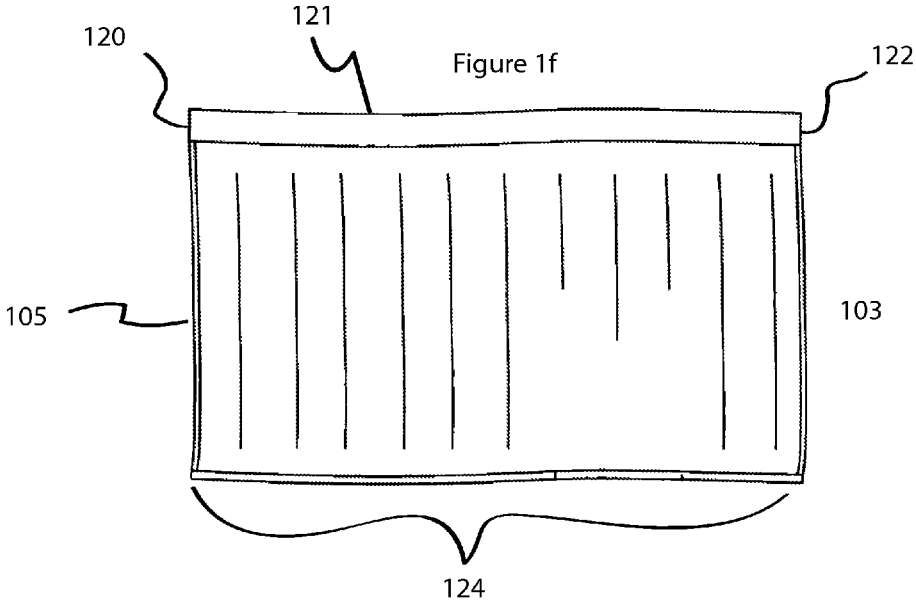
FIG. 1*f* illustrates a front plan view of a solar shade curtain, according to one embodiment of the present teachings.

It will be appreciated that the rod element 101 may be composed of metal, plastic or wood. In one embodiment, as illustrated in FIG. 1*e*, a rod element 101 comprises an inner sleeve 110 operatively coupled to an outer sleeve 114. In this variation, the inner sleeve 110 is adapted to slide inside the outer sleeve 114 such that the rod element 101 is longitudinally adjustable. It will be appreciated that longitudinal adjustability allows a user to customize the rod element 101 length for accommodating varying widths of window jams. Once the user adjusts the rod element 101 length, an affixing element 106 is inserted and secured to lock the desired length in place. In one embodiment, the affixing element 106 comprises a threaded member, such as for example a bolt or screw, into an affixing aperture 116, wherein the affixing aperture 116 comprises complementary threadings for a secure fit for the affixing element 106. In one embodiment, a secondary affixing element 108 is employed in the same manner, to enhance the adjusting capability of the rod element 101.

Figure 2C:
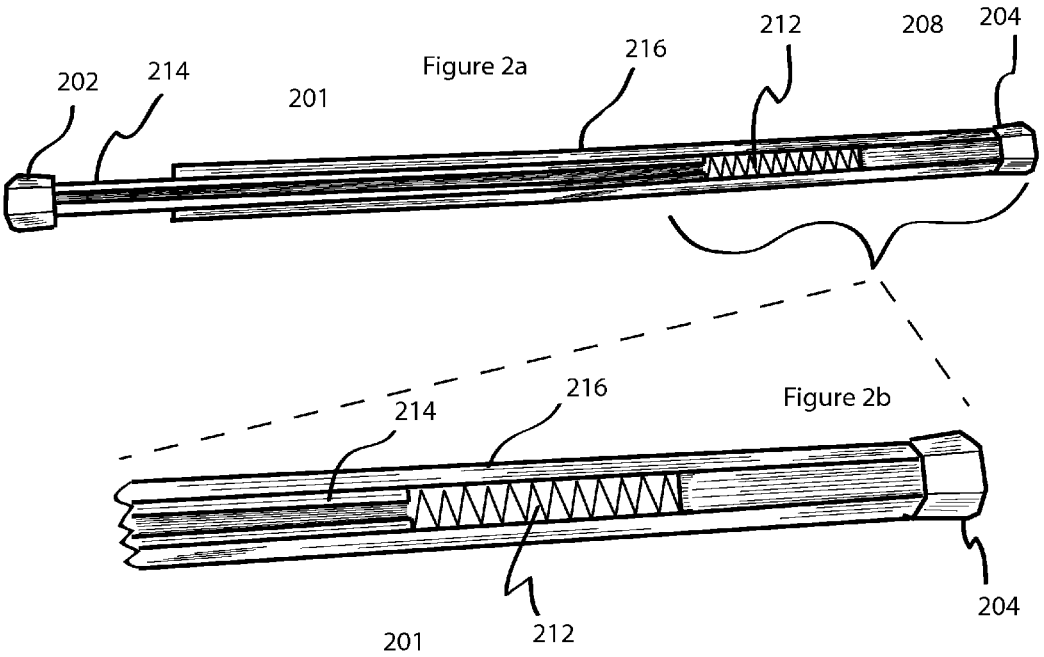
FIG. 2*c* is a perspective view of a crimped cafe rod element of a solar shade curtain, according to one embodiment of the present teachings.
Figure 2C:
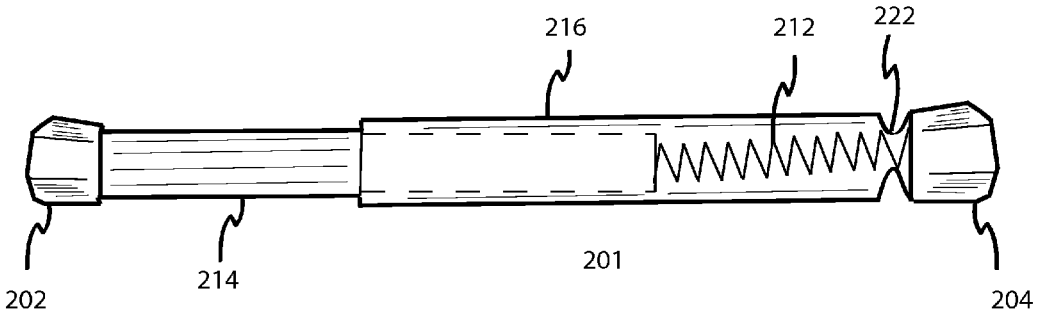

Referring now generally to FIG. 2*a*, FIG. 2*b* and FIG. 2*c*, one embodiment of a cafe rod element 201 is illustrated. The cafe rod element 201 is adapted to fit through the rod pocket 121 described above. In one embodiment, the cafe rod element 201 comprises a left end portion mechanically coupled to an inner tube 214. The inner tube 214 is adapted to fit slidably within an outer tube 216, such that the inner tube 214 actuates within the outer tube 216 along a longitudinal axis. A spring element 212 is disposed internally with respect to the cafe rod element 201 and abuts a right end of the inner tube 214 such that a restoring force from the spring is exerted on the inner tube 214. A user may compress the length of the cafe rod element 201 to fit a width of a window within which a solar shade apparatus is to be used. Once the length of the cafe rod element 201 is determined, the user crimps the cafe rod element 201 at a crimping portion 222, which effectively locks the spring element 212 in place, such that it is no longer able to elongate, but may still be compressed to fit within the window.

Figure 3A:
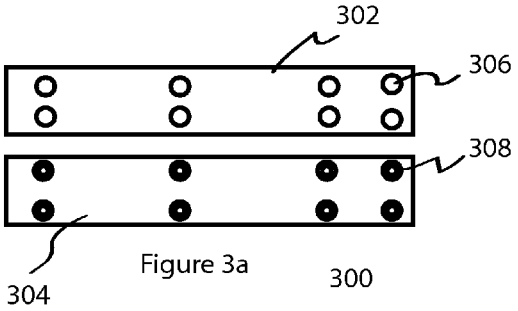
FIG. 3*a* is an inner view of one embodiment of a hemline for a solar shade apparatus, according to the present teachings.
Figure 3B:
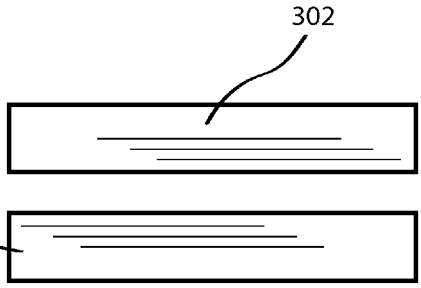
FIG. 3*b* is an outer view of a hemline for a solar shade apparatus, according to the present teachings.

Referring now to FIG. 3*a*, a hemline portion 300 of a solar shade apparatus is disclosed. The hemline portion 300 functions to enclose a bottom portion of the solar shade apparatus, to avoid fraying of the material and to stabilize the generally planar symmetry of the solar shade fabric. In one embodiment, the hemline portion 300 comprises a female side 302 and a male side 304. The female side 302 is adapted to have a plurality of symmetric apertures 306 distributed at a predetermined spacing, such as for example as shown in FIG. 3*a*. The male side 304 is adapted to have a plurality of symmetric protruding portions 308, having a diameter adapted to fit within the diameter of the plurality of symmetric apertures 306, and are distributed at a predetermined spacing. It will be appreciated that the hemline portion 300 may be composed of plastic or any other similar rigid or semi-rigid material. FIG. 3*b* illustrates a side plan view of a backside of a female side 302 and a side plan view of a backside of a male side 304, for a hemline portion 300.

Figure 3C:
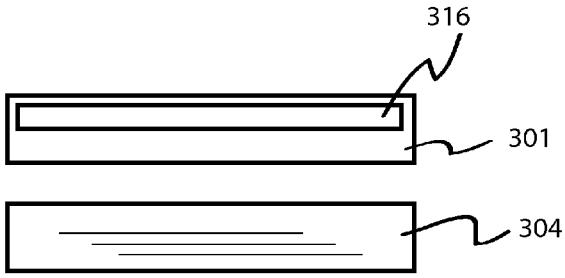
FIG. 3*c* is a side plan view of a magnetic hemline for a solar shade apparatus, according to the present teachings.
Figure 3D:
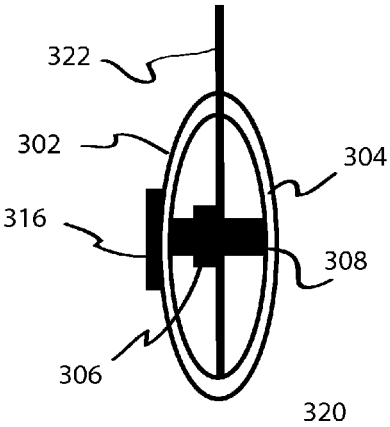
FIG. 3*d* is a cross sectional view of a hemline for a solar shade apparatus, according to one embodiment of the present teachings.
Figure 3E:
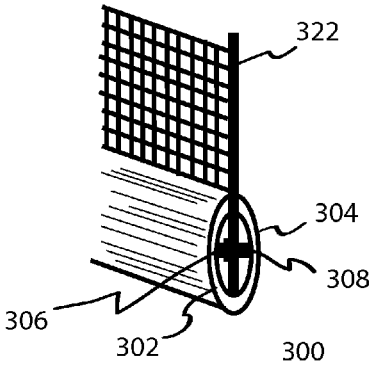
FIG. 3*e* is a perspective view of a hemline for a solar shade apparatus, according to the present teachings.

FIG. 3*e* illustrates a perspective view of one embodiment of a hemline portion 300 having a male side 304 with a protruding portion 308 which is adapted to pierce a solar shade fabric 322 and operatively couple. The protruding portion 308 pierces the solar shade fabric 322 such that it may snap fit into a female side 302 via a plurality of symmetric apertures 306 disposed on an internal region of the female side 302. Coupling in this manner protects the bottom portion of the solar shade fabric and also helps maintain a consistent planar symmetry through the entire apparatus.

FIG. 3*c* illustrates one alternate embodiment of a hemline 310 for a solar shade apparatus, comprising a first plastic portion 301 and a second plastic portion 304. It will be appreciated that a magnet 316, disposed on an outside portion of the first plastic portion 301 comprises an opposite magnetic field from a second magnetic pole disposed on the second plastic portion 304. This configuration of hemline is adapted to "clamp" together using opposite magnetic fields, on either side of a solar shade fabric, as illustrated. The hemline 310 may be used to raise or lower the height of the solar shade.

FIG. 3*d* illustrates one embodiment of a solar shade apparatus hemline 320, which uses a combination of the above-described embodiments. As shown in FIG. 3*e*, a male side 304 is adapted to have a plurality of symmetric protruding portions 308, which function to pierce a solar shade 322 and affix to a female side 302 in a plurality of symmetric apertures 306. In this embodiment, a magnet 316 is affixed to the female side 302 to facilitate a user's grip in raising and lowering the solar shade apparatus 320.

Figure 3F:
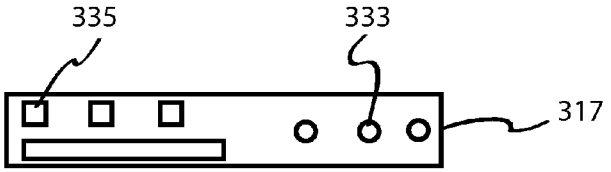
FIG. 3*f* is a front plan view of a hemline for a solar shade apparatus, according to the present teachings.
Figure 3G:
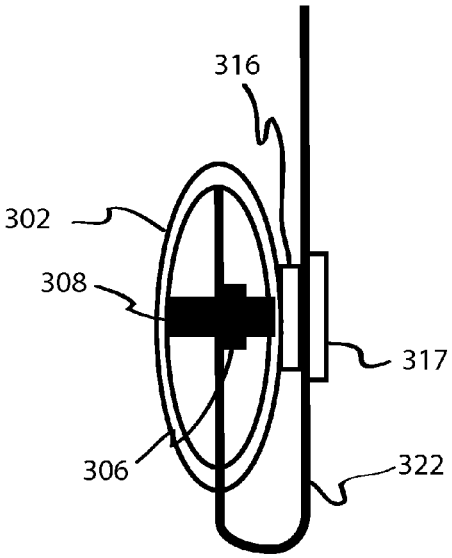
FIG. 3*g* is a side view of a hemline for a solar shade apparatus, according to the present teachings.

FIG. 3*f* is a front plan view of a hemline for a solar shade apparatus, illustrating various affixing elements adapted to affix a hemline in a simple and adjustable manner with a hemline affixing element 317. It will be appreciated that the materials from which the affixing elements are composed may be a magnet 333 and/or a magnetically susceptible material 335, such as steel. Such a configuration is a variation, which may be used in conjunction with the embodiment illustrated in FIG. 3*c* for a hemline 310. In such a configuration, a magnet 316 will magnetically couple to the hemline affixing element 317, as illustrated in FIG. 3*g*, such that the hemline of the solar shade fabric may be raised and lowered, up or down, as required by a user. In this embodiment, the solar shade 322 is folded and looped such that the vertical length of the hemline may be readily adjusted. In the embodiment illustrated in FIG. 3*g*, the solar shade apparatus hemline 320 shown in FIG. 3*d* is used in conjunction with the hemline affixing element 317 such that the vertical length of the solar shade apparatus is adjustable.

Figure 3H:
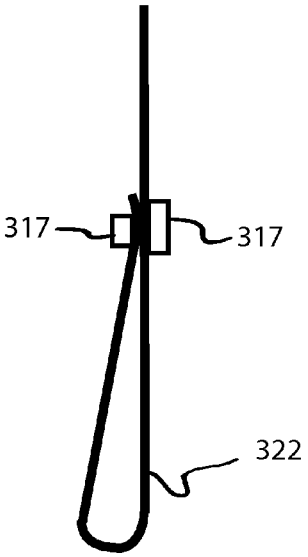
FIG. 3*h* is a side view of a hemline for a solar shade apparatus, according to the present teachings.

In one alternate embodiment, as illustrated in FIG. 3*h*, the solar shade 322 is vertically adjustable using a plurality of hemline affixing elements 317, as shown.

It will be appreciated that the bottom of the hemline may be contoured to fit rounded windows. Variations of the hemline for the solar shade apparatus may include affixing a hemline with a fabric and glue combination and/or a heat resistant plastic.

The foregoing description illustrates exemplary implementations, and novel features, of aspects of a solar shade apparatus. Alternative implementations are suggested, but it is impractical to list all alternative implementations of the present teachings. Therefore, the scope of the presented disclosure should be determined only by reference to the appended claims, and should not be limited by features illustrated in the foregoing description except insofar as such limitation is recited in an appended claim. While the above description has pointed out novel features of the present disclosure as applied to various embodiments, the skilled person will understand that various omissions, substitutions, permutations, and changes in the form and details of the present teachings illustrated may be made without departing from the scope of the present teachings.

Each practical and novel combination of the elements and alternatives described hereinabove, and each practical combination of equivalents to such elements, is contemplated as an embodiment of the present teachings. Because many more element combinations are contemplated as embodiments of the present teachings than can reasonably be explicitly enumerated herein, the scope of the present teachings is properly defined by the appended claims rather than by the foregoing description. All variations coming within the meaning and range of equivalency of the various claim elements are embraced within the scope of the corresponding claim. Each claim set forth below is intended to encompass any apparatus or method that differs only insubstantially from the literal language of such claim, as long as such apparatus or method is not, in fact, an embodiment of the prior art. To this end, each described element in each claim should be construed as broadly as possible, and moreover should be understood to encompass any equivalent to such element insofar as possible without also encompassing the prior art. Furthermore, to the extent that the term "includes" is used in either the detailed description or the claims, such term is intended to be inclusive in a manner similar to the term "comprising."

I claim:

1. An apparatus for shading a window, wherein the window has a right top corner and a left top corner, comprising:

a.) a rod element, having a proximate end and a distal end, disposed along a lateral axis substantially parallel to a lateral window axis;

b.) a spring element, having a first end mechanically coupled to the rod element at the proximate end of the rod element, wherein the spring element is adapted to provide a spring constant force between the rod element and the top left corner of the window, and;

c.) a solar shade fabric, adapted to filter ultra violet rays, removably affixed to the rod element along a lateral axis of the rod element, wherein the rod element distal end is mechanically coupled to the right top corner of the window and the spring element is further mechanically coupled at a second end to the top left corner of the window;

d.) a hemline, comprising a male side having a plurality of symmetric protruding portions piercing a bottom end of the solar shade fabric, affixed to a female side, wherein the female side has a plurality of symmetric apertures for receiving the plurality of symmetric protruding portions of the male side;

e.) a magnet affixed to the male side, wherein the solar shade extends from the bottom of the male side and the female side and folded to form a loop thereby defining a hemline, wherein the solar shade fabric extends upwardly from the hemline and secured to the magnet of the male side by an affixing element such that the hemline of the solar shade fabric may be raised or lowered.

2. The apparatus of claim 1, wherein the solar shade fabric is further adapted to provide thermal insulation.

3. The apparatus of claim 1, wherein the solar shade fabric is adapted to be customizable to fit a plurality of window dimensions.

4. The apparatus of claim 1, adapted for removably affixing to a building window.

5. The apparatus of claim 1, adapted for removably affixing to a mobile home.

6. The apparatus of claim 1, adapted for removably affixing to a recreational vehicle.

7. The apparatus of claim 3, further adapted to be removably affixed to a window having alternative shading elements, selected from the group consisting of: blinds, mini blinds, curtains, shutters, or louvers.

8. The apparatus of claim 1, further adapted to filter light to reduce color fading on carpet, furniture or artwork.

9. The apparatus of claim 1, wherein the solar shade fabric and the rod element are affixed by a sewn or heat fused rod pocket or glued.

10. The apparatus of claim 1, wherein a hemline is disposed at a bottom portion of the solar shade fabric.

11. The apparatus of claim 10, wherein the hemline comprises a plastic strip.

12. The apparatus of claim 11, wherein the plastic strip comprises a first side and a second side, wherein the first side and second side are adapted to snap fit.

13. The apparatus of claim 11, wherein the hemline is secured by one of the following means, consisting of: sewn, glued, or heat fused.

14. The apparatus of claim 1, wherein the solar shade fabric is adapted to reduce glare from external light.

15. The apparatus of claim 1, adapted to provide a semi-transparent view, adapted to provide no view and to provide privacy.

16. The apparatus of claim 12, wherein the plastic strip is adapted to pierce the hemline for the snap fit.

17. The apparatus of claim 10, wherein the hemline comprises a magnetic strip.

18. The apparatus of claim 11, wherein the hemline is fused using a patch having glue, wherein the glue adheres to the solar shade fabric when heat is applied to the patch.

19. The apparatus of claim 1, wherein the rod element is adapted to have a variable length.

20. The apparatus of claim 6, adapted to fit into rounded windows.

* * * * *